US006694678B2

(12) United States Patent
Schneider

(10) Patent No.: US 6,694,678 B2
(45) Date of Patent: Feb. 24, 2004

(54) APPARATUS AND METHODOLOGY FOR LIMITING ICE BUILD-UP

(76) Inventor: Brian J. Schneider, 72 Stutzman Rd., Bowmansville, NY (US) 14026

( * ) Notice: Subject to any disclaimer, the term of this patent is extended or adjusted under 35 U.S.C. 154(b) by 14 days.

(21) Appl. No.: 10/147,385

(22) Filed: May 16, 2002

(65) Prior Publication Data

US 2003/0213183 A1 Nov. 20, 2003

(51) Int. Cl.[7] ..... E04D 13/00

(52) U.S. Cl. ..... 52/11; 134/166 C; 134/93; 47/65.5

(58) Field of Search ..... 52/11, 12; 47/79, 47/80, 65.5, 68, 41.11, 41.13; 222/189.06, 189.07; 239/38; 134/166 R, 166 C, 93

(56) References Cited

U.S. PATENT DOCUMENTS 3,184,890 A * 5/1965 McKey ..... 47/73
4,991,345 A * 2/1991 Bloch ..... 47/79

* cited by examiner

*Primary Examiner*—Carl D. Friedman
*Assistant Examiner*—Yaoko Slack
(74) *Attorney, Agent, or Firm*—Hodgson Russ LLP

(57) ABSTRACT

An apparatus for limiting ice build-up in a gutter, the apparatus deployable in a gutter which has a bottom, the apparatus comprising a housing comprising sidewalls and a base comprising a top side, the sidewalls joined to the top side of the base with the side walls defining a salt block opening through which the salt block is loadable into the housing, with one of the side walls defining a flow opening for allowing frozen precipitation to pass therethrough and contact the salt block and melt.

31 Claims, 8 Drawing Sheets

APPARATUS AND METHODOLOGY FOR LIMITING ICE BUILD-UP

BACKGROUND

A typical building has a roof and one or more gutters adjacent to the roof. The gutters controllably route water flowing off the roof into storm sewers and other appropriate locations where it can do no damage to the building. However, problems occur when gutters are unable to quickly and completely drain water from a roof, as is the case when the gutter becomes obstructed/plugged with leaves, twigs, pine needles, ice, and other debris. When this happens, water flowing off the roof cannot flow through the gutters and into the gutter downspouts. Rather, the water begins flowing and seeping in an uncontrollable manner. The water flowing off the roof may overflow the gutter and undesirably fall in close proximity to the building's foundation, or it may seep under shingles on the roof where it can then cause portions of the roof and building to decay. None of these scenarios are desirable.

An obstructed gutter becomes a significant problem during cold weather months when air temperatures hover at or below freezing (zero degrees Celsius). Heat loss from the building, along with daytime warming, turns snow and ice on the roof into melt water which flows towards and into the gutter. Then, when air temperatures fall below freezing, the melt water in the gutter quickly freezes. Again and again the same sequence of events occur, and the ice in the gutter builds. An ice dam eventually forms, and the ice choked gutter ceases to function. The ice dam places a great load on the gutter and on the gutter spikes that hold the gutter to the building. Then, melt water flowing from the roof may freeze on top of the ice dam adding to its size, or it may flow over the ice dam and begin dripping off the roof. The dripping melt water may freeze into large, heavy, and destructive icicles.

The problems associated with ice dams and icicles are numerous. For example, the great loads associated with icicles and ice dams can rip gutters completely off a building. This results in structural damage to the building, as well as ruined gutters. Also, property in the path of the falling gutters is frequently damaged.

Even if the gutter is not ripped from the structure, there is an insidious problem associated with ice dams. When water flowing off a roof encounters the ice dam it tends to stagnate, and it eventually begins to seep under the shingles on the building's roof. Repeated freezing/melting cycles cause the shingles to lift more and more from the roof, and melt water eventually seeps into the interior of the building. Water may then begin dripping inside the structure's walls and from the ceiling. As a result, the ceiling itself may become water logged and/or permanently stained. Thus, costly water damage can occur because the gutter failed to function in cold weather.

To date, there is no satisfactory solution for the chronic problem of ice choked gutters. For example, some individuals attach electric type resistance heating wires on the roof and in the gutters. However, in addition to being quite expensive to purchase and operate, these wires are of no use in the event of power failure. Yet another drawback with the electric heating wires is that downspouts are difficult to keep ice free. Further, when warm weather returns, time must be spent to remove the heater wires located in the gutter, otherwise the wires will trap leaves and debris.

Thus, there is a need for an inexpensive, effective, easy to manufacture and use apparatus for limiting ice build-up, that is not dependent on an external power source.

SUMMARY

The present apparatus provides a solution to the problem of ice clogged gutters and downspouts by limiting the formation of ice dams. The apparatus comprises a housing into which a salt block is loadable. When a snowfall occurs, the snow contacts the salt block, melts into salty melt water, and flows off the salt block and into the gutter. The salty melt water flows through the gutter melting ice it contacts, thus limiting the formation of ice dams in the gutter. The salty melt water then flows through the gutter downspouts keeping them ice free as well. A methodology is also provided setting forth the manners of installing, positioning, and using the apparatus.

The housing comprises side walls and a base. A salt block, sized so as to be receivable inside the housing, is loadable into the housing. The side walls are joined at one end thereof to the base and define a salt block opening through which the salt block is loadable into the housing. Cutouts are defined in one or more of the side walls so that snow may directly contact the salt block. Once the snow contacts the salt block it melts, turns into salty melt water, and flows out of the gutter. The housing may also comprise a hook which allows the housing to be releaseably attachable to the gutter by setting the hook over a gutter spike ferrule or over the end of the gutter. The apparatus may also comprise a lid which is sized so that it is fittable over the salt block. The lid may define a cutout to allow frozen precipitation to pass therethrough and contact the salt block.

An exemplary method of deploying the apparatus comprises loading the salt block into the housing, fitting the lid over the salt block, and positioning the hook over a gutter spike ferrule or the end of the gutter. Then, when snow or freezing rain fall, they melt upon contacting the salt block. Salty melt water flows off the salt block and into the gutter, melting any ice it contacts as it travels. When the salty melt water flows through the downspout, it melts any ice accumulations therein. This process repeats for each subsequent snowfall. Also, in heavy snowfall the gutter may become drifted over with snow. Nevertheless, it will remain substantially free of ice and snow, because the salt block will continue to melt any snow it contacts and the salty melt water will limit ice build-up.

Thus, the apparatus solves the problems associated with ice clogged gutters and the damage associated therewith. These and other advantages of the present apparatus for limiting ice build-up are described in the following detailed description.

DESCRIPTION

Figure 1:
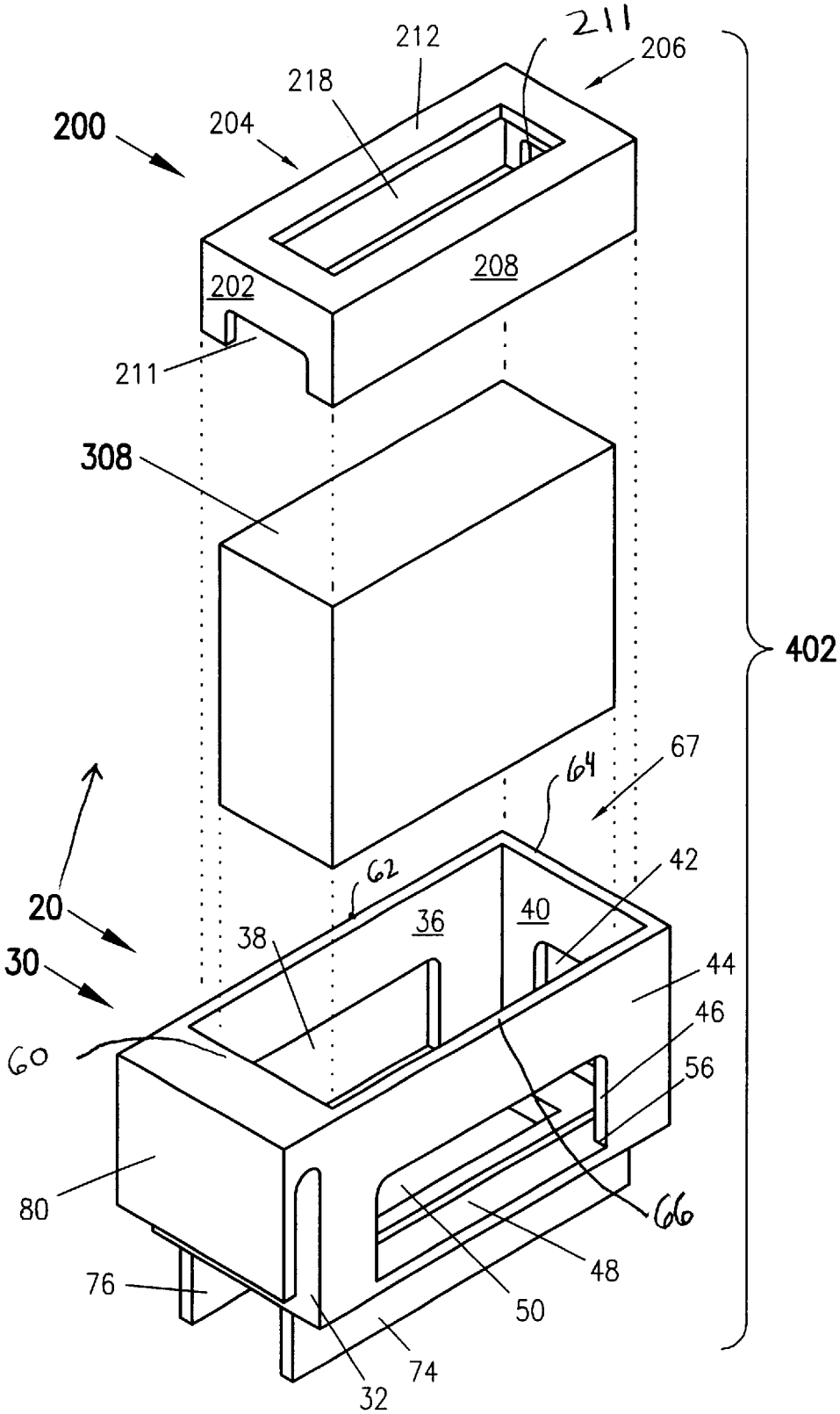
FIG. 1 shows an exploded view of the apparatus for limiting ice build-up.
Figure 8:
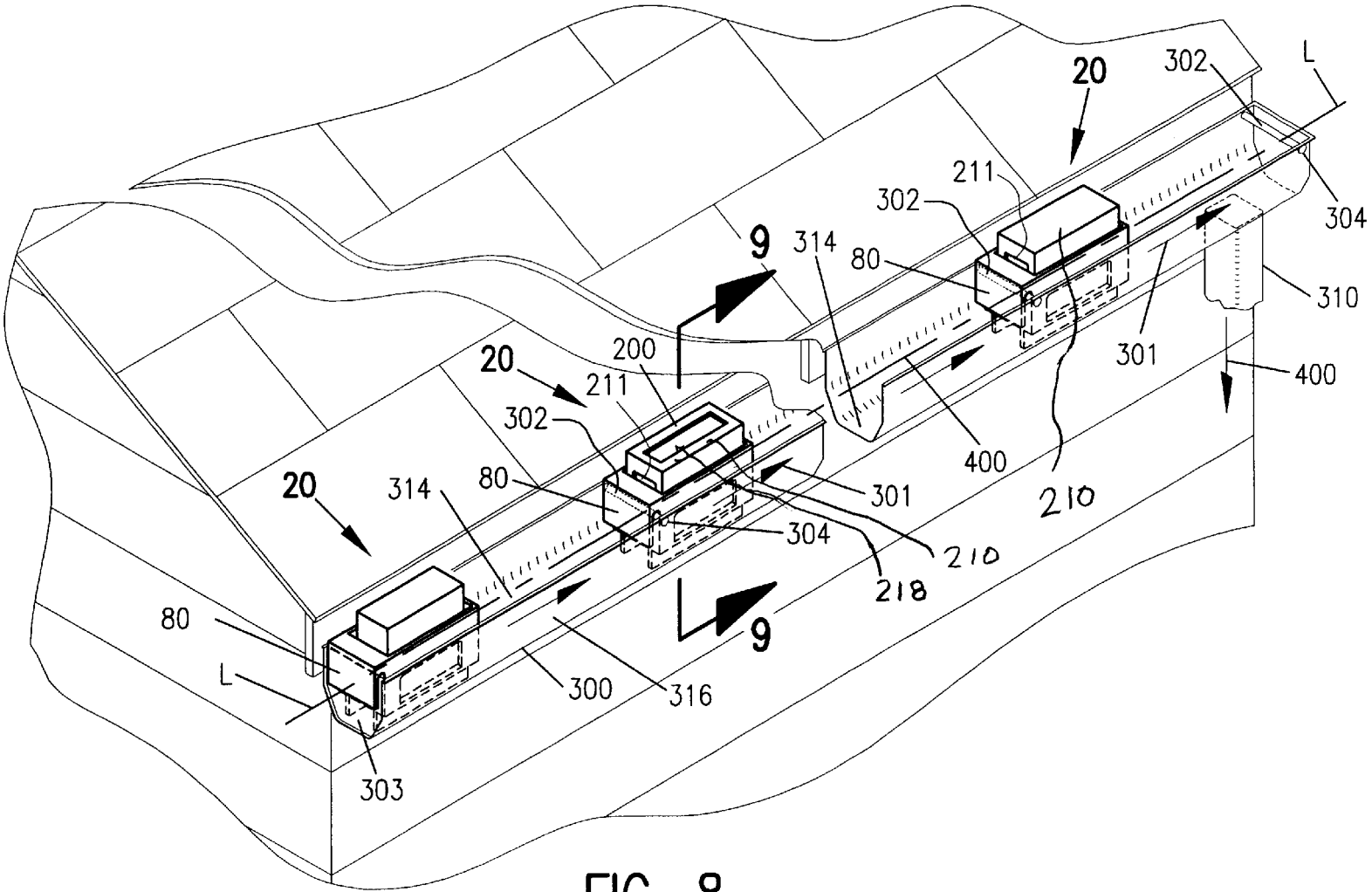
FIG. 8 shows a partial cutaway perspective view of a plurality of the apparatuses deployed in a gutter.
Figure 9:
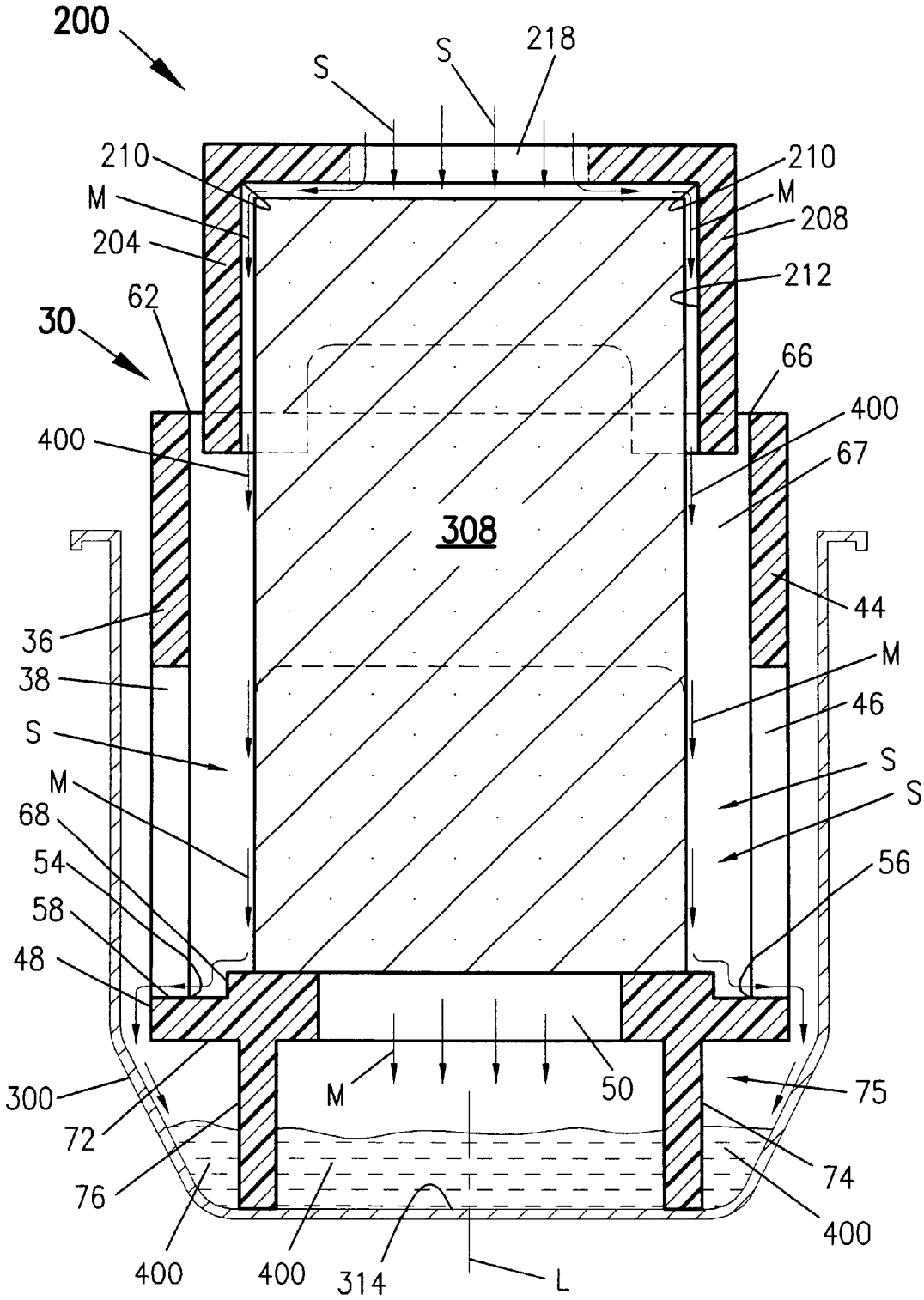
FIG. 9 shows a sectional end elevational view of the apparatus and the gutter taken along cut line 9—9 of FIG. 8.
Figure 10:
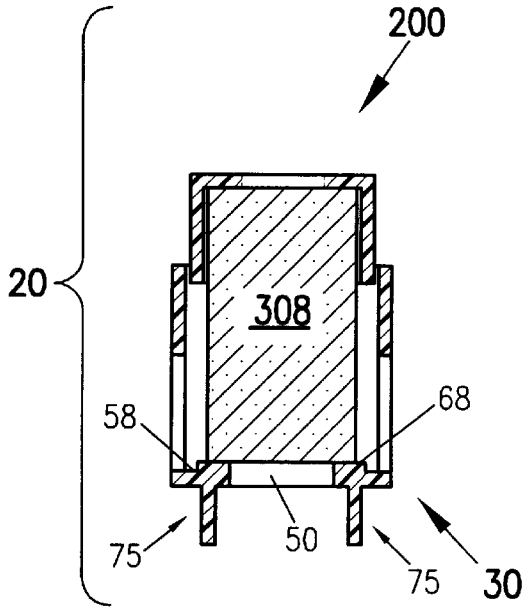
FIGS. 10–13 show sectional end elevational views of the apparatus and salt block as the salt block dissolves and shrinks, while simultaneously the lid moves into the housing.

The apparatus 20 for limiting ice build-up is shown in the exploded view of FIG. 1. The apparatus 20 comprises a housing 30 into which a salt block 308 is loadable. The housing 30 comprises a hook 80 which allows the apparatus 20 to be releasably attachable to an end of a gutter 303 or to a gutter spike ferrule 302, as seen in the partial cutaway perspective view of FIG. 8. When snowfall and/or other frozen precipitate contact the salt block 308 held in the housing 30, they quickly melt and turn into salty melt water 400 as seen by the arrows designated M in FIG. 9. The salty melt water 400 proceeds to melt ice and/or snow it contacts as it travels through the gutter 300 (FIGS. 8 and 9). The melting action of the salty melt water 400 thus limits ice build-up and the formation of ice dams in the gutter 300. Additionally, ice build-up is also limited in the downspout 310 (FIG. 9), because the salty melt water 400 melts any ice it contacts as it flows through the downspout 310. One of the advantages of the apparatus 20 is that even if the gutter 300 becomes drifted over with snow and/or ice, the bottom 314 of the gutter 300 itself remains ice free. Thus, the apparatus 20 effectively limits ice build-up and the formation of ice dams without the need of an external power source.

Figure 2:
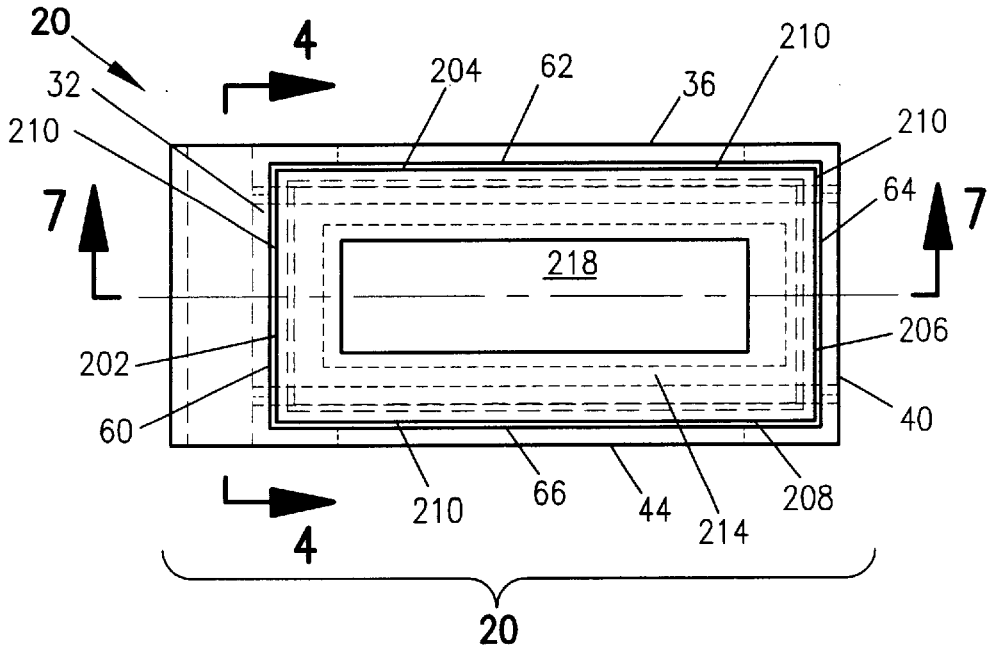
FIG. 2 shows a top plan view of the apparatus.
Figure 3:
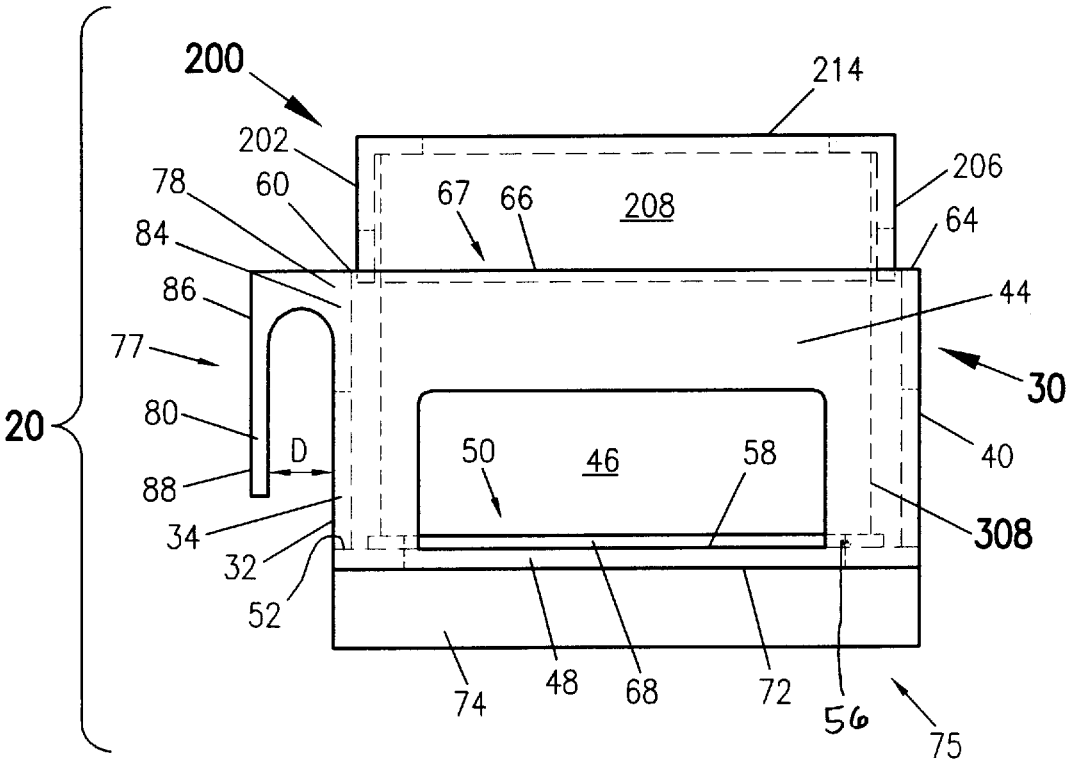
FIG. 3 shows a front side elevational view of the apparatus.
Figure 5:
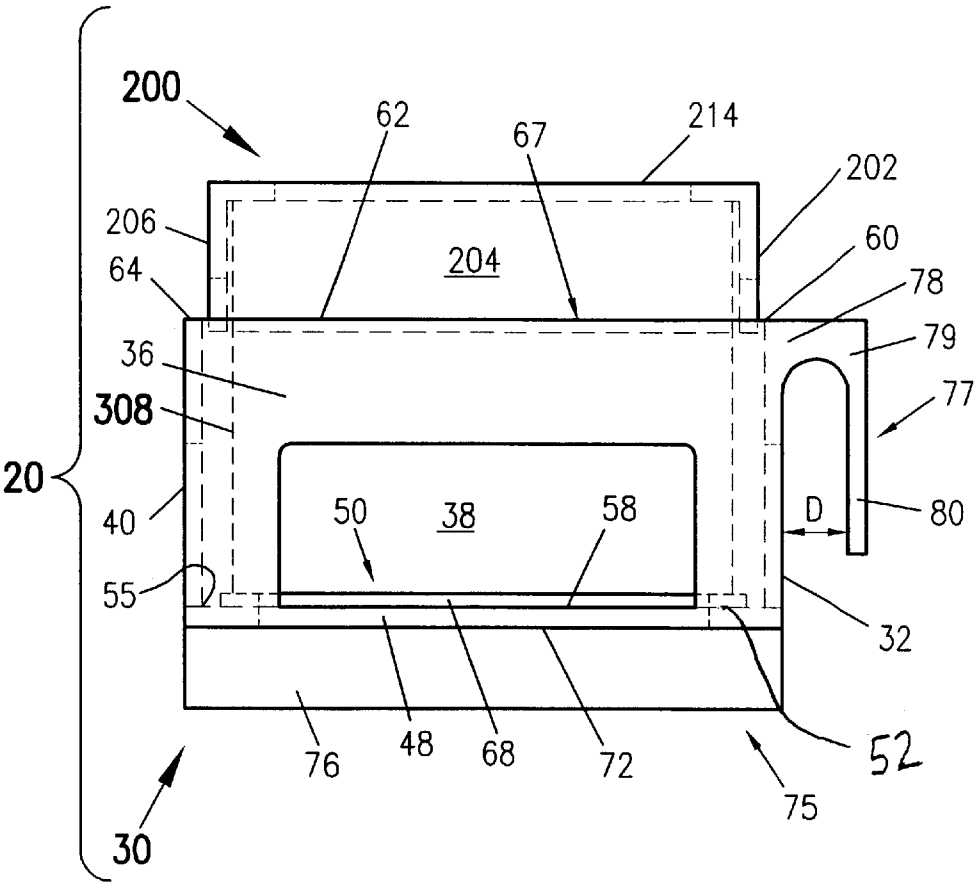
FIG. 5 shows a rear side elevational view of the apparatus.

Turning now to FIGS. 1–3, shown therein is the apparatus 20 which comprises a housing 30 into which a salt block 308 is loadable. The housing 30 comprises a first side wall 32 defining a first flow opening 34 (shown in FIG. 3), a second side wall 36 defining a second flow opening 38 (shown in FIG. 1), a third side wall 40 defining a third flow opening 42 (shown in FIG. 1), a fourth side wall 44 defining a fourth flow opening 46 (shown in FIG. 1), and a base 48 defining a base flow opening 50. The housing 30 further defines a salt block opening 67 through which a salt block 308 is receivable, the salt block opening 67 in the housing 30 opposite the base 48. Each of the flow openings 34, 38, 42, 46 respectively, and the base flow opening 50 are for allowing snow (designated S in FIG. 9) and/or ice to pass therethrough and directly contact the salt block 308 and turn into salty melt water 400, as seen in FIG. 9

The first side wall 32, the second side wall 36, the third side wall 40, and the fourth side wall 44 are each aligned and joined along their first edges 52, 54, 55, and 56 respectfully, to the top side 58 of the base 48, as seen in FIGS. 3–6. The second edges 60, 62, 64, 66 respectively of the first side wall 32, second side wall 36, third side wall 40, and fourth side wall 44 define the salt block opening 67, as seen in FIGS. 1, and 3–5.

Figure 4:
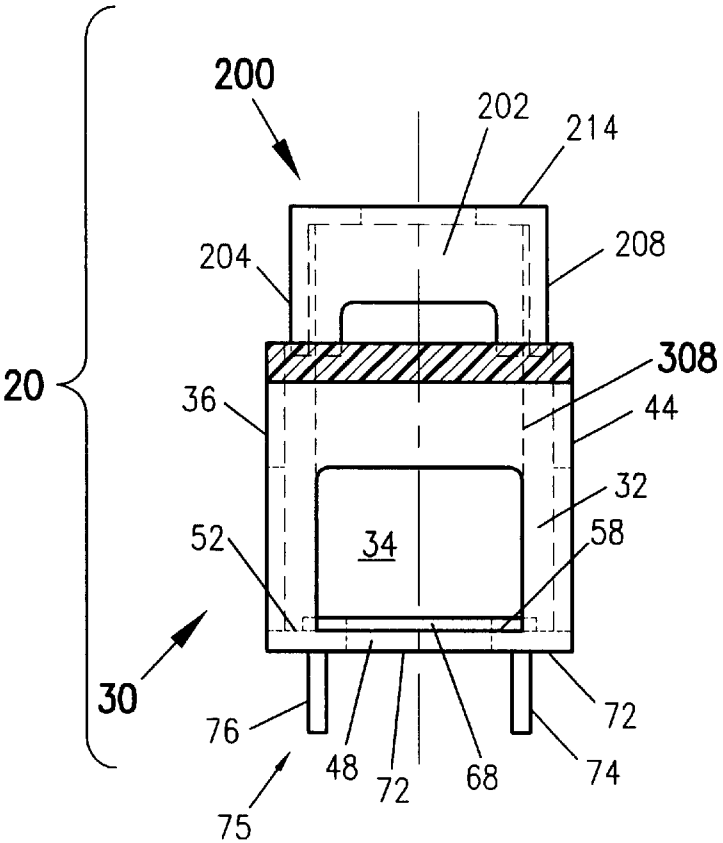
FIG. 4 shows a sectional end elevational view of the apparatus taken along cut line 4—4 of FIG. 2.

FIG. 4 shows a sectional end elevational view taken along cut line 4—4 of FIG. 2. This figure shows the first side wall 32 which defines the first flow opening 34, along with the second and fourth side walls 36 and 44 respectively.

The base 48 of the housing 30 comprises an elevated platform 68 on its top side 58 that extends about the periphery of the base flow opening 50, as seen in FIGS. 1–3, 5, and 10–13. The utility of the elevated platform 68 to be described presently. The housing 30 further comprises means for elevating 75 the base 48 which are joined with and extend from the bottom side 72 (FIGS. 3–6, and 9) of the base 48. The means for elevating the base 75 may comprise a first riser 74 and second riser 76 as seen in FIGS. 4–7. In such an embodiment, the first riser 74 and second riser 76 are spaced from one another and are substantially parallel to one another. The first and second risers 74, 76 respectively keep the base 48 elevated above the bottom 314 of the gutter 300. The first and second risers 74, 76 are substantially parallel to the longitudinal axis (designated L in FIG. 8) of the gutter 300 when the apparatus 20 is deployed in a gutter 300, as seen in FIG. 8. The means for elevating the base 75 preserve the lifespan of the salt block 308, especially in the event there is a heavy rainstorm, because the salt block 308 is elevated in an out of the way location, relative to water streaming along the bottom 314 of the gutter 300. Additionally, the means for elevating the base 75 do not obstruct the gutter 300, because they are parallel to the path that flowing water takes when flowing through the gutter 300. In yet other embodiments, the means for elevating the base 75 may comprise: one riser; three or more risers; pins; rods; and support columns joined to the bottom side 72 of the base 48.

Figure 7:
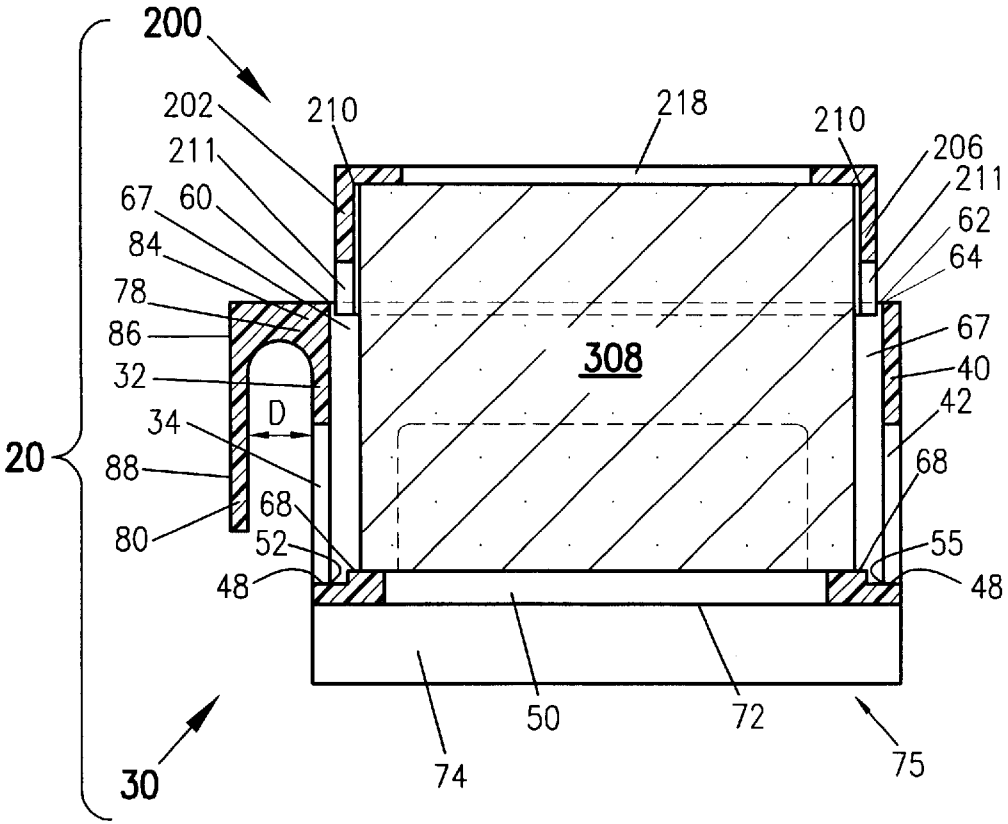
FIG. 7 shows a sectional front side elevational view of the apparatus taken along cut line 7—7 of FIG. 2.
Figure 6:
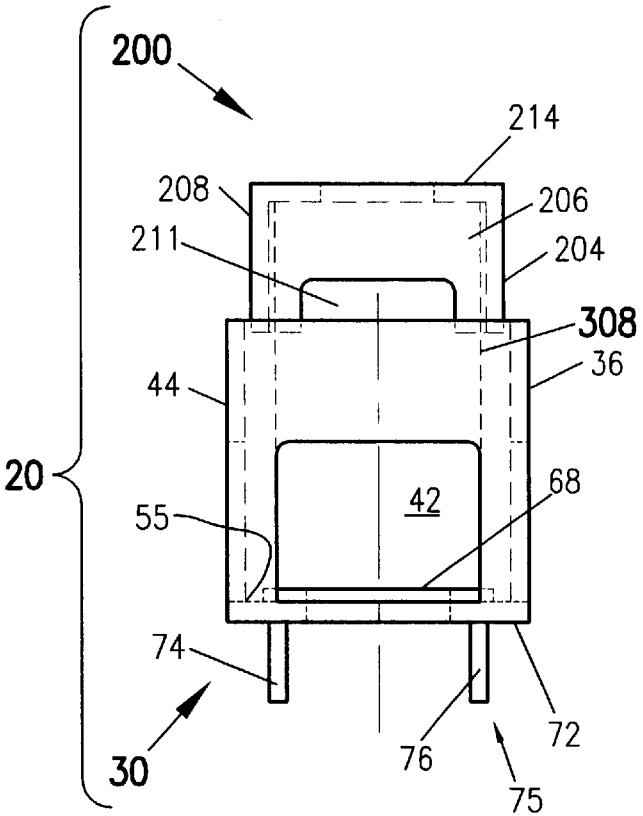
FIG. 6 shows an end elevational view of the apparatus.

Turning now to FIG. 7, this figure is a sectional frontal side elevational view taken along cut line 7—7 of FIG. 2. The housing 30 comprises a hook 80, which comprises an extension portion 78 having a first end 84 adjacent to and joined with the second edge 60 of the first side wall 32. Joined with the second end 86 of the extension portion 78 is a depending portion 88, which depends in a direction towards the base 48. The depending portion 88 is spaced a distance designated D in FIGS. 3 and 7 away from the first side wall 32. The distance designated D is a sufficient distance from the first side wall 32 so that the hook 80 is releasably attachable to a gutter spike ferrule 302, which surround gutter spikes 304, or releaseably attachable to the end 303 of the gutter 300, as seen in FIG. 8. Even though the hook 80 inhibits the movement of the apparatus 20 in the gutter 300, the hook 80 provides for a quick and easy way to install and remove the apparatus 20 from the gutter 300.

As seen in FIGS. 1–4, 8, 9, and 10–13 the apparatus 20 may further comprise a lid 200 for covering the salt block 308. The lid 200 prevents the uncontrolled dissolving of the salt block 308 by the weather and rain. In other words, it serves to control the degree to which snow/rain are able to contact and dissolve the salt block 308. As seen in FIGS. 1 and 2, the lid 200 comprises: a first member 202 joined with a second member 204 at one end thereof, and joined with a fourth member 208 at the other end thereof, as seen in FIG. 2. The lid further comprises a third member 206 joined with the second and fourth members 204, 208 respectively. The first member 202, second member 204, third member 206, and fourth member take on a rectangular box-shape, as seen in FIG. 2. The lid 200 has a top shield 212, which may define a lid cutout 218 as seen in FIGS. 1–2, and 9. Each of the first, second, third, and fourth members 202, 204, 206, 208 respectively, has an edge commonly designated by reference number 210 as seen in FIGS. 2, 7, and 9. The top shield 212 is joined with the edges 210.

Additionally, as seen in FIGS. 1, and 7–8, the first member 202 and the third member 206 may define lid flow paths 211 through which water can flow. More water can flow through the lid flow paths 211 as the salt block 308 melts and decreases in size. This advantageous feature is useful in the event the salt block 308 is completely dissolved and a large rainstorm occurs. Storm water in the gutter 300 could flow directly through the lid flow paths 211 unobstructed, as well as along the bottom 314 of the gutter 300, and the apparatus 20 would not act as a dam in the gutter 300.

Figure 15:
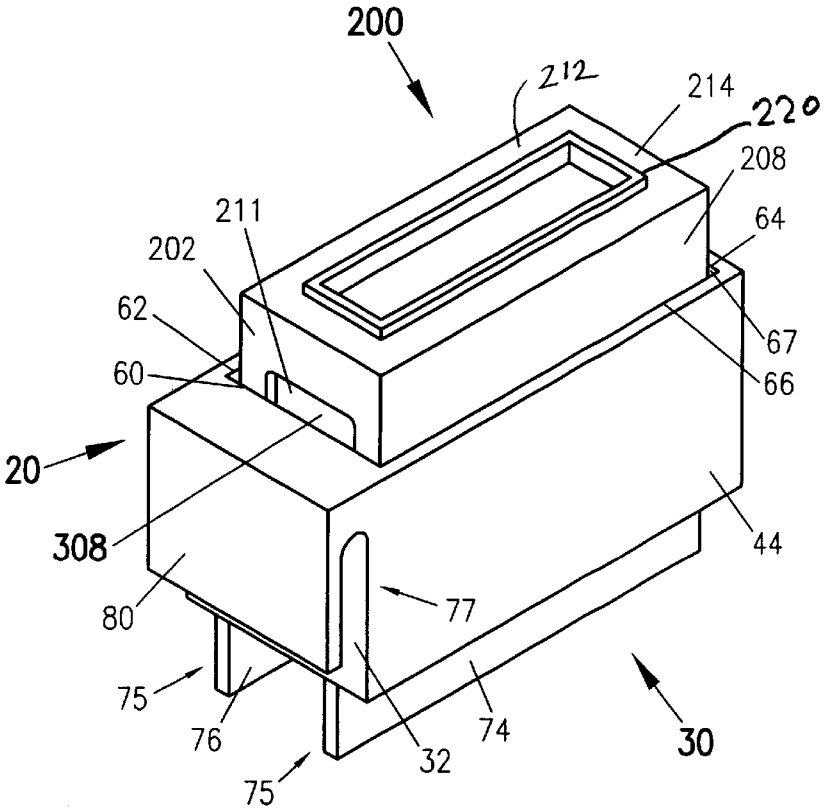
FIG. 15 shows an embodiment wherein the apparatus wherein the side walls do not have cutouts.

The lid 200 may be embodied such that the lid cutout 218 is surrounded by a raised lip 220 as shown in FIG. 15 about its periphery, the lip 220 for controlling water flow on the top shield 212. The lip 220 lip limits the amount of rain water that can flow off the top shield 212, through the lid cutout 218, and onto the salt block 308. A lip 220 surrounding the lid cutout 218 could thus assist in extending the lifespan of the salt block 308.

Use and Operation

Prior to using the apparatus 20, the user clears out all debris from the gutter 300 including leaves, twigs, pine needles, and nests. A user may find it helpful to wait until all the leaves have fallen from the trees prior to installation of the apparatus 20 in the gutter 300. Then, the user takes the apparatus 20 and loads a salt block 308 into the housing 30 and places the lid 200 on the salt block 308. The salt block 308 is sized such that it is in a close fitting relationship with the lid 200. Once loaded into the housing 30, the salt block 308 itself rests on the elevated platform 68 which extends from the base 48.

Next, the apparatus 20 is releasably attached to a gutter spike ferrule 302 or an end of the gutter 303. There are at least two ways to deploy apparatus 20. The user may place the hook 80 over the gutter spike ferrule 302, or the user may place the hook 80 over the end of the gutter 303 as seen in FIG. 8. For maximum melting, an apparatus 20 is deployed at each gutter spike ferrule 302, as well as at each end 303 of the gutter 300. An apparatus 20 may even be hooked to the end 303 of the gutter 300 such that it is positionable directly over the downspout 310. The apparatus 20 itself cannot move into the downspout 310, because it is securely hooked and because of its size. As time progresses and the salt block 308 dissolves, the user may insert new salt block 308 into the housing 30. The apparatus 20 is removed from the gutter 300 after the cold weather season.

The superior configuration of the housing 30 and lid 200 provide for superior snow and ice melting. When snow or frozen precipitation falls and comes into contact with the salt block 308, it melts. The snow may contact the salt block 308 through one or more of the first flow opening 34, second flow opening 38, third flow opening 42, fourth flow opening 46, base opening 50, lid cutout 218, and the lid flow paths 211. After melting, the salty melt water 400 (FIGS. 8 and 9) flows off the salt block 308 and into the gutter 300. Once this salty melt water 400 enters the gutter 300, any accumulated snow/ice in the gutter 300 melts and flows to a downspout 310. Enough salt dissolves from the salt block 308 to prevent the gutter 300 from filling with ice, limiting ice buildup and the formation of destructive ice dams in the gutter 300. Further, since the first and second risers 74,76 are parallel to the longitudinal axis (designated L in the figures) of the gutter 300, salty melt water 400 is able to freely flow under the base 48 of the housing 30. Additionally, if snow is heavy and a snow drift forms and covers the gutter 300, the apparatus 20 continues to melt ice in the gutter 300 thus always keeping the gutter 300 from filling with ice, so long as a salt block 308 is maintained is maintained in the gutter 300.

The housing 30 and lid 200 are uniquely configured to facilitate the melting snow while simultaneously preventing excessive rapid dissolving of the salt block 308. The elevated platform 68 that extends from the top side 58 of the base 48 supports the salt block 308 thereon so that the salt block 308 is elevated with respect to the surrounding top side 58 of the base 48, as seen in FIG. 9. Then, when salty melt water 400 flows off the salt block 308, the elevated salt block 308 does not sit in a pool of salty melt water 400. Thus, the structure for the elevated platform 68 is advantageous because it prevents the undesirable rapid dissolving of the salt block 308. Also, the base flow opening 50, which the elevated platform 68 surrounds, aids in preventing ice from forming on the bottom side 72 of the base 48. This prevents ice from building-up/accumulating directly under the apparatus 20, as there is direct access between salt block 308, the base flow opening 50, and the gutter 300. In other words, any ice in the gutter 300 under the base flow opening 50 is melted by either contacting the salt block 308 or having salty melt water 400 drip on it through the base flow opening 50.

The following is an example of operation in a snowfall. FIG. 9 is the section view taken along cut line 9—9 of FIG. 8. Seen therein is the flow of precipitate (snow, ice) when it passes through the lid cutout 218. In FIG. 9, the arrows designated S indicate snowfall. Once the snow contacts the salt block 308 it melts into salty melt water 400. It then flows over the salt block 308 as indicated by the arrows designated M in FIG. 9. The salty melt water 400 flows down the side of the salt block 308, onto the top side 58 of the base 48, and then into the gutter 300. Then, when the salty melt water 400 moves through the gutter 300, it is salty enough to melt snow and ice in the gutter 300. In the event an ice jam begins to form under the apparatus 20, it is quickly melted upon contacting the salt block 308, or having salty melt water 400 drip on it through the base flow opening 50.

Figure 11:
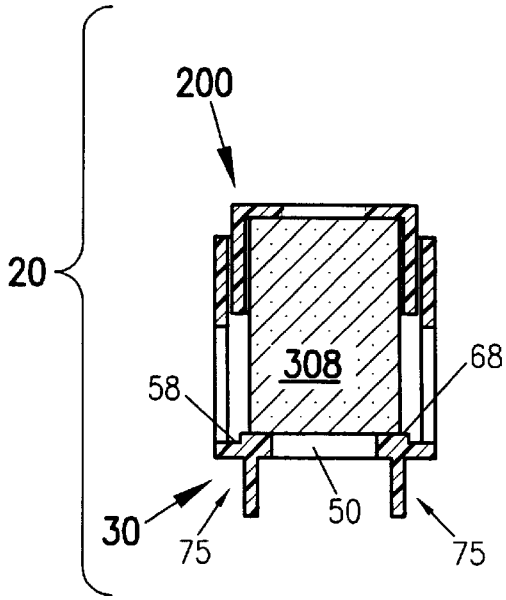
Figure 12:
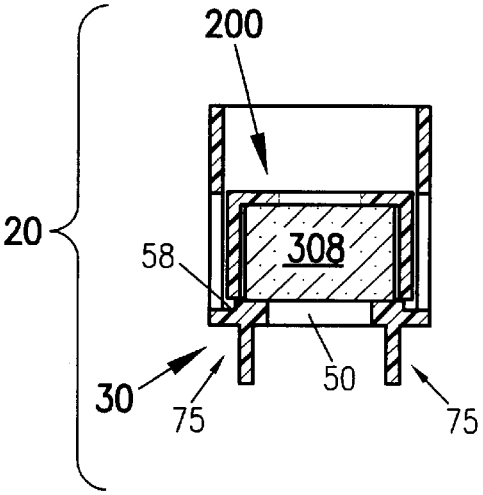
Figure 13:
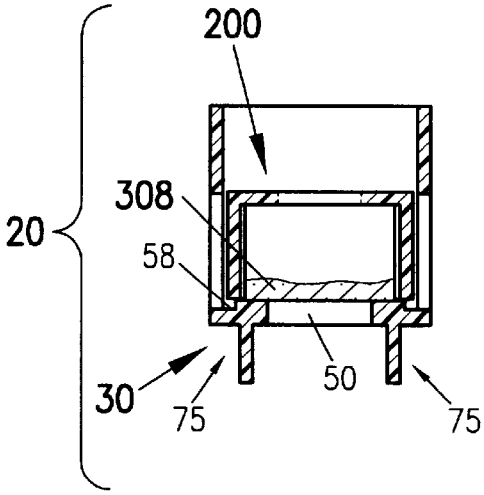

As the salt block 308 decreases in size due to snowfalls/rain, the lid 200 lowers into the housing 30, which is possible because the lid 200 is sized to be receivable through the salt block opening 67. This is shown in FIGS. 10–13. At the beginning, the lid 200 is partly within the housing 30 as shown in the sectional view of FIG. 10. This ensures that as the salt block 308 dissolves and decreases in size the lid 200 neatly lowers into the housing 30, and does not get caught up at an angle as it lowers into the housing 30. The salt block 308 melts as shown in FIGS. 11–13, and the first member 202, second member 204, third member 206, and fourth member 208 come to rest on the top side 58 of the base 48, and surround the elevated platform 68. The lid 200 itself is captured in the housing 30, and this is advantageous because the captured lid 200 is not free to move through the gutter 300 or cause an obstruction in a downspout 310. The lid flow paths 211 then allow for water to pass through the apparatus 20. After the salt block 308 completely dissolves, the user may raise the lid 200 and insert another salt block 308, or remove the apparatus 20 altogether if the cold weather season is over.

Figure 14:
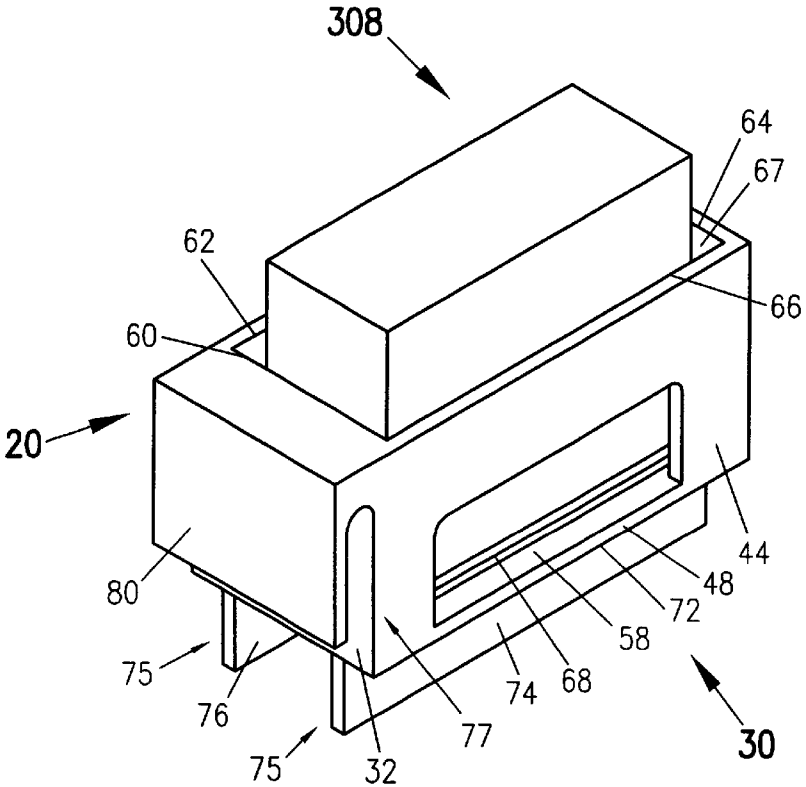
FIG. 14 shows an embodiment of the apparatus wherein a lid is not utilized.

The apparatus 20 is deployable in a gutter 300 without any lid 200, with a lid 200 in which the lid's 200 top shield 212 defines a lid cutout 218, or with a lid 200 in which the top shield 212 does not have a lid cutout 218, as sequentially shown in FIG. 8. If the lid 200 is absent, snow has increased access to the salt block 308, as seen in FIGS. 8 and 14. This may be useful in "problem areas" where ice dams are a chronic problem. In other embodiments, one or more of the first flow opening 34 in the first side wall 32, second flow opening 38 in the second side wall 36, third flow opening 42 in the third side wall 40, fourth flow opening 46 in the fourth side wall 44, and the lid cutout 218 in the lid 200 may be replaced with a solid walls. In such embodiments, the number of flow openings 34, 38, 42, 46, and the need for a lid cutout 218 may be varied to meet the specific needs of a particular gutter and/or a particular geographic area.

If the geographic region has snowy winters, the apparatus 20 may be embodied with the full compliment of flow openings 34, 38, 42, 46, and lid cutout 218. If the geographic region experiences very harsh snowy winters, the apparatus 20 may be deployed with no lid 200 at all (FIG. 14). This would allow for maximum salt to snow contact and snow and ice melting. If, however, the geographic region has mild winters with rainy days far outnumbering snowy days per season, another embodiment of the apparatus 20 might be used that comprises less than the full complement of flow openings 34, 38, 42, 46, and lid cutout 218.

For example, FIG. 15 shows no cutouts other than the lid flow path cutouts 211, the lid cutout 218, and bottom opening 50. This is because if the full complement of openings 34, 38, 42, and 46 are provided for in the apparatus 20, and it mostly rains all winter, the salt block 308 would simply melt and need to be replaced without ever being used to melt snow. Hence, different geographic regions may call for alternate embodiments of the apparatus 20, wherein the use of flow openings 34, 38, 42, 46, and lid cutout 218 can be properly adjusted to meet specific needs.

It is noted that the versatile apparatus 20, regardless of whether it embodies all the flow openings 34, 38, 42, 46, 50, and lid cutout 218, can be sized and shaped so that it is receivable in a gutter 300 having a cross section different from what is seen in FIG. 9, for example, a semicircular cross sectioned gutter, without departing from the principles described herein.

In other embodiments, the apparatus 20 may be constructed without hook 80. In such embodiments, the first riser 74 and second riser 76 rest on the bottom 314 of the gutter 300, and the housing 30 is placed upstream of a gutter spike ferrule 302. In such an embodiment, the housing 30 remains stationary, even as water passes through the gutter 300, because the housing 30 abuts the gutter spike ferrule 302.

The apparatus 20 may be constructed of: plastic; wood; fiberglass; rubber; metals; injection molded plastics, thermoformed plastics, and combinations thereof. An advantage of injection molding the apparatus is that by way of economies of scale, the apparatus 20 may be mass produced rapidly and at low cost. Injection molding may be employed to rapidly form the apparatus 20. The injection molding entails heating the plastic from which the apparatus 20 is to be made, injecting the plastic into a mold/dies, cooling the mold/dies, and ejecting the finished product, which in this case is the apparatus 20. A substantially similar process may be utilized in order to quickly form lids 200 by injection molding processes, which entail injecting heated plastic into an appropriated mold, cooling the mold, and ejecting the finished product, in this case the lid 200.

The salt block 308 itself may comprise pure NaCl (sodium chloride), or NaCl blended with other materials in order to prolong the life of the salt block and/or alter the deicing properties of the salt block. Further, the salt block 308 may contain a dye so the building owner can quickly visually contrast the salt block 308 from snow and ice, and make a determination if the salt block 308 has completely dissolved. Use of a dye also allows the building owner to quickly visually verify the salty melt water 400 is flowing properly.

Also, the present apparatus 20 lend itself to a kit 402 comprising the housing 30, the salt block 308, and the lid 200, as shown in FIG. 1. A user could readily purchase the kit 402 and have everything necessary for limiting snow and ice build-up in gutters 300.

It will be appreciated by those skilled in the art that while the apparatus 20 has been described in connection with particular embodiments and examples, the apparatus 20 is not necessarily so limited, and that other embodiments, examples, uses, and modifications and departures from the embodiments, examples, and uses may be made without departing from the apparatus 20 described herein.

What is claimed:

1. An apparatus for holding a salt block to melt ice, the apparatus comprising:

a) a housing comprising side walls and a base comprising a top side and a bottom side, the base defines a base flow opening having a periphery and the housing is for holding the salt block therein;

b) an elevated platform extending upwardly from the top side of the base, the elevated platform surrounding at least part of the periphery of base flow opening and the elevated platform for supporting the salt block thereon;

c) each side wall comprising a first edge and a second edge, the first edges joined with the top side of the base and the second edges defining a salt block opening for allowing the salt block to be loaded into the housing;

d) at least one of the sidewalls defines a flow opening for allowing frozen precipitation to pass therethrough and contact the salt block in the housing; and e) means for elevating the base extending from the base for supporting the housing.

2. The apparatus of claim 1 wherein the second edge of one of the side wall is joined with a hook, the hook for allowing the housing to be hooked to to an end of a gutter or over a gutter spike ferrule so that the apparatus is releaseably attachable to the end of the gutter or gutter spike ferrule.

3. The apparatus of claim 1 wherein the second edge of one of the side walls is joined with a hook, the hook for hooking onto an end of a gutter or over a gutter spike ferrule so that the housing is releaseably attachable to the end of the gutter or gutter spike ferrule, and wherein the hook further comprises an extension portion having a first end adjacent to and joined with the second end of the one of the side walls, and wherein the extension portion comprises a second end joined with a depending portion which depends therefrom in the direction of the base.

4. The apparatus of claim 3 wherein the depending portion is separated from one of the side walls by a sufficient distance so that the hook is readily positionable over the gutter spike ferrule or the end of the gutter.

5. The apparatus of claim 1 further comprising a lid, the lid sized such that it is receivable through the salt block opening.

6. The apparatus of claim 5 wherein the lid comprises a first member, a second member, a third member, and a fourth member, each having an edge joined with a top shield, the lid for controlling precipitation flow into the housing.

7. The apparatus of claim 6 wherein the top shield defines a lid cutout, and the top shield further comprises a raised lip surrounding lid cutout.

8. The apparatus of claim 1 wherein the means for elevating the base extends from the bottom side of the base.

9. The apparatus of claim 1 wherein the apparatus is made of materials selected from the group consisting of: plastics; thermoformable plastics, injection moldable plastics, wood; metal; metal alloys; composites; fiberglass; and combinations thereof.

10. An apparatus for holding a salt block to melt ice, the apparatus comprising:

a) a housing for holding the salt block, the housing comprising a base comprising a top side and a bottom side, and the base defines a base flow opening having a periphery, the base further comprises an elevated platform extending upwardly from the top side of the base for supporting the salt block, the elevated platform surrounding at least part of the periphery of base flow opening;

b) wherein the housing further comprises a first side wall, a second side wall, a third side wall, and a fourth side wall, wherein the first side wall, second side wall, third side wall, and fourth side wall each comprise a first edge and a second edge, the first edges positionable on the top side of the base in a rectangular box-shaped arrangement and joined therewith, and the second edges defining a salt block opening through which the salt block is loaded into the housing;

c) means for elevating the base extending from the bottom side of the base and for supporting the housing; and d) wherein at least one of the first side wall, second side wall, third side wall, and fourth side wall defines a flow opening for allowing precipitation to pass therethrough and contact the salt block.

11. The apparatus of claim 10 wherein the second edge of the first wall has joined thereto a hook, the hook for hooking the housing onto an end of a gutter or over a gutter spike ferrule so that the housing is releaseably attachable to the end of the gutter or gutter spike ferrule.

12. The apparatus of claim 11 wherein the hook further comprises an extension portion having a first end adjacent to and joined with the second end of one of the first side wall, and having a second end joined with a depending portion which depends in a direction towards the base.

13. The apparatus of claim 12 wherein the depending portion is separated from the first wall by a distance, the distance of sufficient amount that the hook is positionable over the gutter spike ferrule or positionable over the end of the gutter.

14. The apparatus of claim 10 wherein the salt block opening defined by the second edges of the first side wall, second side wall, third side wall, and fourth side is sized so that the salt block may be received therethrough.

15. The apparatus of claim 14 further comprising a lid, the lid sized such that it is receivable through the salt block opening.

16. The apparatus of claim 15 wherein the lid comprises a first member, a second member, a third member, and a fourth member, in a rectangular box-shaped arrangement and joined with a top shield, the lid for controlling the rate at which the salt block dissolves by controlling the degree of accessibility of precipitation to the salt block.

17. The apparatus of claim 16 wherein the top shield defines a lid cutout.

18. The apparatus of claim 17 further comprising a lip surrounding the periphery of the lid cutout, the lip for preventing liquid water on the top shield from uncontrollably flowing though the lid cutout and onto the salt block.

19. The apparatus of claim 10 wherein the means for elevating the base comprises one of the following selected from the group consisting of: a first housing riser and a second housing riser substantially parallel to one another, one or more housing rises, pins and rods extending from the base, and support columns affixed to the bottom side of the base.

20. The apparatus of claim 10 further comprising a lid fittable over the salt block and wherein the housing and lid are made of materials selected from the group consisting of: plastic; wood; thermoformable plastics, injection moldable plastics, metal; metal alloys; composites; fiberglass; and combinations thereof.

21. A method for limiting ice build-up in a gutter having a bottom comprising the acts of:

a) providing an apparatus which comprises a housing;

b) providing the housing with a base;

c) providing a means for elevating the base for elevating the base above the bottom of the gutter;

d) defining a salt block opening in the housing;

e) providing the housing with side walls and defining a flow opening in one of the sidewalls, the flow opening for allowing snow to pass therethrough;

f) providing the housing with a hook;

g) loading a salt block into the housing by moving the salt block through the salt block opening and then into the housing; and h) deploying the apparatus in the gutter by hooking the hook to an end of the gutter or over a gutter spike ferrule.

22. The method according to claim 21 further comprising the acts of:

a) providing a plurality of apparatuses;

b) providing a gutter comprising a plurality of gutter spike ferrules and ends;

c) hooking an apparatus to each of the gutter spike ferrules and to the ends of the gutter; and d) providing and placing a lid over the salt block.

23. The method according to claim 21 comprising the acts of a) forming the apparatus by a process selected from the group of processes comprising:
thermoforming a plastic, injection molding a plastic, and blow molding a plastic.

24. The method according to claim 21 comprising the further acts of:

a) providing a lid and defining a lid cutout in the lid;

b) sizing the lid so that it is receivable in the housing;

c) placing the lid over the salt block; and d) loading a new salt block into the housing when a previous salt block dissolves.

25. A kit for limiting ice build-up in a gutter having a bottom comprising:

a) a salt block;

b) an apparatus comprising a housing, the housing comprising a base comprising a top side and bottom side and a means for elevating the base, the means for elevating the base joined with the bottom side of the base;

c) the housing further comprising sidewalls having first edges and second edges, the sidewalls are each joined with the top side base along the first edges thereof, at least one of the side walls defines a flow opening for allowing snow to pass therethrough, the second edges of the side walls defining a salt block opening through which the salt block is loadable into the housing; and d) a lid, the lid sized to be fittable over the salt block and receivable through the salt block opening defined in the housing, the lid for covering the salt block.

26. The kit according to claim 25 wherein the housing further comprises a hook extending from the second edge of one of the side walls, the hook for releasably attaching the apparatus to a gutter spike ferrule or an end of the gutter.

27. The kit of claim 25 wherein the housing and the lid are made of materials selected from the group consisting of: plastic; wood; metal; metal alloys; composites; fiberglass; thermoformable plastics, injection moldable plastics, and combinations thereof.

28. A method for limiting ice build-up in a gutter comprising the acts of:

a) providing a housing;

b) providing the housing with a base;

d) providing the housing with side walls and defining a flow opening in at least one of the sidewalls, the side walls defining a recess in the housing and the flow opening for allowing precipitation to pass therethrough;

c) providing means for elevating the base for elevating the base above the bottom of the gutter;

g) loading a salt block into the recess defined by the sidewalls of the housing and placing a lid on top of the salt block; and h) placing the housing in a gutter such the means for elevating the base contact the gutter.

29. The method for limiting ice build-up in a gutter according to claim 28 comprising the further acts of:

a) allowing the salt block to dissolve as precipitation contacts it;

b) removing the lid from the housing;

c) loading another salt block in the recess defined by the sidewalls of the housing; and d) placing the lid on the salt block.

30. An apparatus comprising:

a) a housing comprising side walls and a base comprising a top side and a bottom side, the base defines a base flow opening having a periphery;

b) an elevated platform extending upwardly from the top side of the base, the elevated platform surrounding at least part of the periphery of base flow opening;

c) each side wall comprising a first edge and a second edge, the first edges joined with the top side of the base and the second edges defining an opening in the housing;

d) at least one of the sidewalls defines a flow opening; and e) means for elevating the base extending from the base and for elevating the housing.

31. An apparatus comprising:

a) a housing comprising side walls and a base comprising a top side and a bottom side, the base defines a base flow opening having a periphery;

b) an elevated platform extending upwardly from the top side of the base, the elevated platform surrounding at least part of the periphery of base flow opening;

c) each side wall comprising a first edge and a second edge, the first edges joined with the top side of the base and the second edges defining an opening in the housing;

d) at least one of the sidewalls defines a flow opening; and e) a lid, the lid sized such that it is receivable through the opening in the housing.

* * * * *